US007456711B1

(12) United States Patent
Goldsmith

(10) Patent No.: US 7,456,711 B1
(45) Date of Patent: Nov. 25, 2008

(54) TUNABLE CAVITY FILTERS USING ELECTRONICALLY CONNECTABLE PIECES

(75) Inventor: Charles L. Goldsmith, Plano, TX (US)

(73) Assignee: Memtronics Corporation, Plano, TX (US)

( * ) Notice: Subject to any disclaimer, the term of this patent is extended or adjusted under 35 U.S.C. 154(b) by 67 days.

(21) Appl. No.: 11/270,768

(22) Filed: Nov. 9, 2005

(51) Int. Cl.
*H01P 1/208* (2006.01)

(52) U.S. Cl. ..... 333/209; 333/231; 333/235

(58) Field of Classification Search ..... 333/208, 333/209, 223, 231, 232, 235
See application file for complete search history.

(56) References Cited

U.S. PATENT DOCUMENTS 4,692,727 A * 9/1987 Wakino et al. ..... 333/219.1
6,043,727 A * 3/2000 Warneke et al. ..... 333/205
2003/0119677 A1* 6/2003 Qiyan et al. ..... 505/210
2005/0270125 A1* 12/2005 Higgins et al. ..... 333/209

* cited by examiner

*Primary Examiner*—Benny Lee
(74) *Attorney, Agent, or Firm*—Carr LLP

(57) ABSTRACT

An apparatus and a method are provided for electronically tuning cavity filters. A tunable cavity comprises at least two pieces of material, such as metal plates or metal traces, and MEMS circuitry interconnecting the pieces of material. Multiple tunable cavities can be combined to create a tunable cavity filter. In one embodiment, a waveguide cavity filter comprises a metal insert attached to a substrate. At least two pieces of material and MEMS circuitry reside within the cavities produced by the metal insert. The MEMS circuitry can be controlled to connect or disconnect the pieces of material, which alters the electric and magnetic fields inside the cavities. In another embodiment, a MEMS positioner inside the cavity filter can physically deform or move a piece of material within the cavity. By altering the electric and magnetic fields within the cavities the resonant frequency of the cavity filter can be tuned.

15 Claims, 8 Drawing Sheets

TUNABLE CAVITY FILTERS USING ELECTRONICALLY CONNECTABLE PIECES

GOVERNMENT LICENSE RIGHTS

The U.S. Government has a paid-up license in this invention and the right in limited circumstances to require the patent owner to license others on reasonable terms as provided for by the terms of Contract No. HQ006-05-C-7117 awarded by the Missile Defense Agency.

FIELD OF THE INVENTION

The present invention relates generally to electronically tunable electronic filters, and more particularly, to filters electronically tuned with microelectromechanical systems (MEMS) devices and circuits.

DESCRIPTION OF THE RELATED ART

Filtering electronic signals is a fundamental function performed in most electronic systems built today. The need to separate or isolate signals of differing frequency is commonly used to differentiate desired from undesired signals in communications systems, or to evaluate differing signals in sensor systems. Therefore, the ability to filter electronic signals is highly desirable.

A fundamental measure of the quality of an electronic filter is its insertion loss to desired signals and its rejection of undesired signals. Great measures are commonly taken to reduce filter insertion loss and improve filter rejection through careful engineering design and proper selection of materials. Reducing losses with desired signals and improving rejection of undesired signals reduces complexity and cost of the remaining system electronics, and improves the ability to process and discriminate these signals later in the system.

There are two broad classes of electronic filters: those constructed from lumped element components, such as inductors and capacitors; and those constructed from resonant elements, such as resonant cavities or dielectric resonators. The design and operation of both of these types of filters is determined by the operating frequency and the relative size between the signal wavelength and the size of the filter components. At lower frequencies, electronic filters are commonly constructed with discrete inductors and capacitors, which make up the resonant circuits for the filter. At higher frequencies, where the operating wavelengths are on the same order as the dimensions of the components, distributed elements such as transmission lines or resonant cavities are used to construct filters.

The quality factor (Q-factor) of the components used to construct the filter determines what the ultimate insertion loss and rejection of the filter will be. The Q-factor is the ratio of reactance X to resistance R of the component at the frequency of interest ($Q=X/R$). It is generally desirable to construct filters with high Q-factor (high-Q) components such that the final filter is as efficient and effective as possible, although the cost and/or the complexity of the high-Q components can preclude the use of these components.

Tunability is an important characteristic for an electronic filter, as it allows several differing filter functions to be accomplished by a single component. This significantly reduces cost and complexity in electronic systems. The common problem with tuned filters is that the components which perform the tuning generally do not have a high-Q factor, which causes the filter to exhibit degraded loss and rejection performance. A tunable filter, with a high-Q factor, would be an improvement over the prior art.

SUMMARY OF THE INVENTION

This application provides an apparatus and a method for electronically tuning cavity filters. A tunable cavity comprises at least two pieces of material, such as metal plates or metal traces, and MEMS circuitry interconnecting the pieces of material. Multiple tunable cavities can be combined to create a tunable cavity filter. In one embodiment, a waveguide cavity filter comprises a metal insert attached to a substrate. At least two pieces of material and MEMS circuitry reside within the cavities produced by the metal insert. The MEMS circuitry and the pieces of material are attached to the substrate within the cavity. The MEMS circuitry can be controlled to connect or disconnect the pieces of material, which alters the electric and magnetic fields inside the cavities. In another embodiment, a MEMS positioner inside the cavity filter can physically deform or move a piece of material within the cavity. By altering the electric and magnetic fields the resonant frequency of the cavity filter can be tuned. Although these cavity filters are tunable, they retain a higher Q-factor than conventional tunable filters.

BRIEF DESCRIPTION OF THE DRAWINGS

For a more complete understanding of the present application and the advantages thereof, reference is now made to the following descriptions taken in conjunction with the accompanying drawings, in which.

DETAILED DESCRIPTION OF THE INVENTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning network communications, electromagnetic signaling techniques, and the like, have been omitted inasmuch as such details are not considered necessary to obtain a complete understanding of the present invention, and are considered to be within the understanding of persons of ordinary skill in the relevant art.

It is desirable to incorporate MEMS devices and components into tunable filters because the Q-factor of MEMS devices is much higher than their conventional counterparts, such as p-i-n diodes or field effect transistors (FETs). MEMS varactors (variable capacitors) can also be incorporated into tunable filters because of their high Q-factor. This allows tunability with reduced loss and improved rejection. In fact, the Q-factor of the MEMS devices are so high that often the loss of the filter is set by the remaining fixed elements rather than the tunable elements. At frequencies above 1 GHz, the Q-factor of inductors or capacitors may range from 10-50 and transmission line Q-factors may range from 100-200. Alternatively, the Q-factor of MEMS devices can range from 300-500 or higher. Therefore, constructing tunable filters of improved performance requires combining higher Q-factor, fixed filter elements with those of tunable MEMS devices.

At microwave and millimeter-wave frequencies (2 GHz and above), the highest Q-factor filter elements are those of resonant air-filled metal cavities. A properly constructed cavity may have Q-factors in the thousands or higher. In this disclosure, the MEMS device are not used to add inductance or capacitance to the circuit, but can be used to modify the electric and magnetic fields within the cavity, which alters its resonant frequency. Therefore, the operating frequency of very high Q-factor cavity resonators can be modified to operate over a range of frequencies as a tunable filter element.

Figure 1:
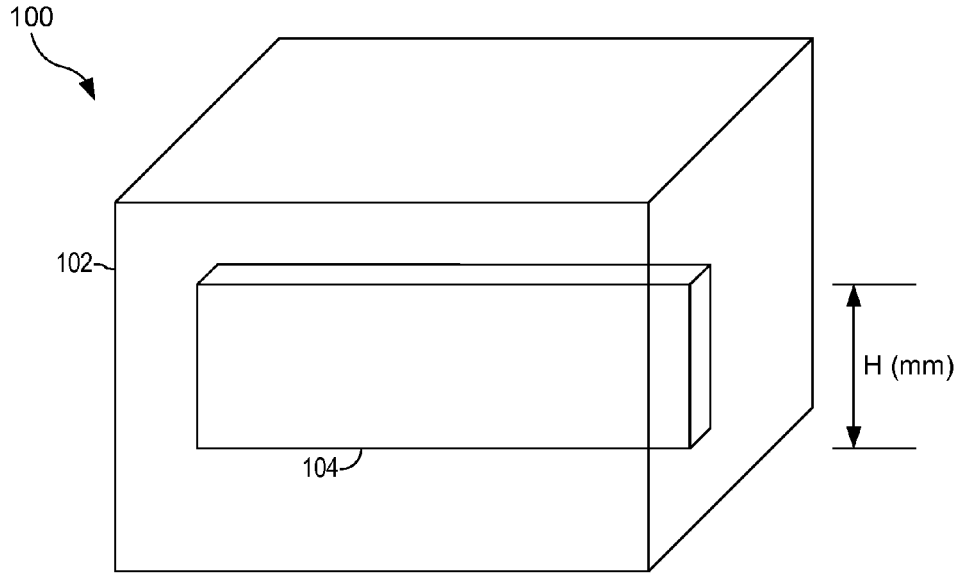
FIG. 1 is a resonant cavity with a metal plate insertion.

FIG. 1 depicts a tunable resonant cavity 100 with a metal plate insertion. A metallized box 102 filled with air operates with multiple resonant frequencies. The resonant frequencies are dependent on the physical dimensions of the box and the permittivity and/or permeability of the material occupying the box 102. For example, an air-filled box 102 with dimensions of 22.86 mm×22.86 mm×10.16 mm has a lowest resonant frequency of 9.27 GHz. Accordingly, there are higher resonant frequencies for a cavity filter, but this disclosure focuses on the lowest resonant frequency. A first mode of a filter element is its lowest resonant frequency. Near the lowest resonant frequency a filter only has one mode, whereas at higher frequencies the filter may have multiple modes. In practice, a number of resonant cavities 100 can be combined to create a tunable cavity filter.

Figure 2:
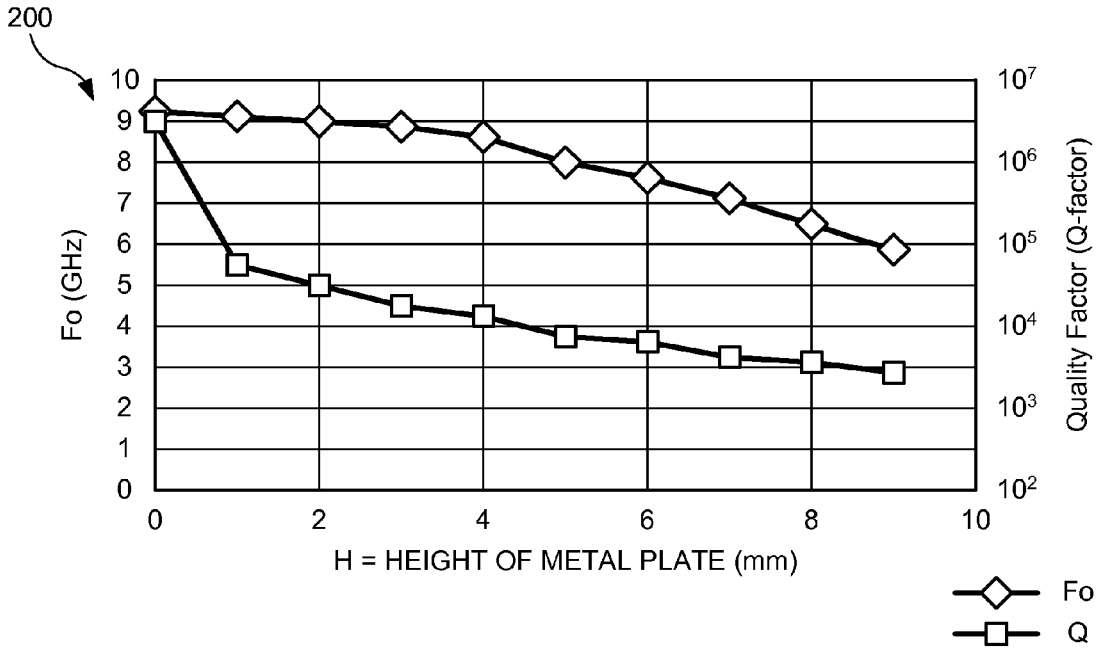
FIG. 2 is a graphical representation of the resonant frequency and the Q-factor of the resonant cavity with a metal plate insertion of varying dimensions.

By inserting a thin, metal plate 104 into the middle of the box 102, the resonant frequency of the cavity 100 changes. The metal plate 104 alters the electric and magnetic fields, which changes the first mode or lowest resonant frequency. As the height H of the metal plate 104 increases the resonant frequency decreases. FIG. 2 is a graphical representation 200 of the resonant frequency and the Q-factor of the resonant cavity 100 with a metal plate insertion 104. The diamond plot points indicate the resonant frequency $F_0$, which is shown on the left y-axis of the graph 200. The square plot points indicate the Q-factor, which is shown on the right y-axis of the graph 200. The x-axis represents the height H (mm) of the metal plate 104. Accordingly, FIG. 2 represents the resonant frequency $F_0$ and the Q-factor of the filter 100 as a function of the height H of the metal plate 104 within the cavity 100. As the height H of the metal plate 104 increases, the resonant frequency $F_0$ and the Q-factor decrease. The higher the metal plate 104 is, the more it perturbs the electric and magnetic fields by changing the electromagnetic structure of the first mode and modifying its resonant frequency $F_0$. This resonant cavity 100 demonstrates greater than a 30% reduction in resonant frequency $F_0$, while still maintaining a Q-factor above 1000. The amount of tuning is dependent on the electromagnetic field distributions for the resonant mode of interest, as well as the position, dimensions, and composition of the materials used to perturb the field.

Figure 3:
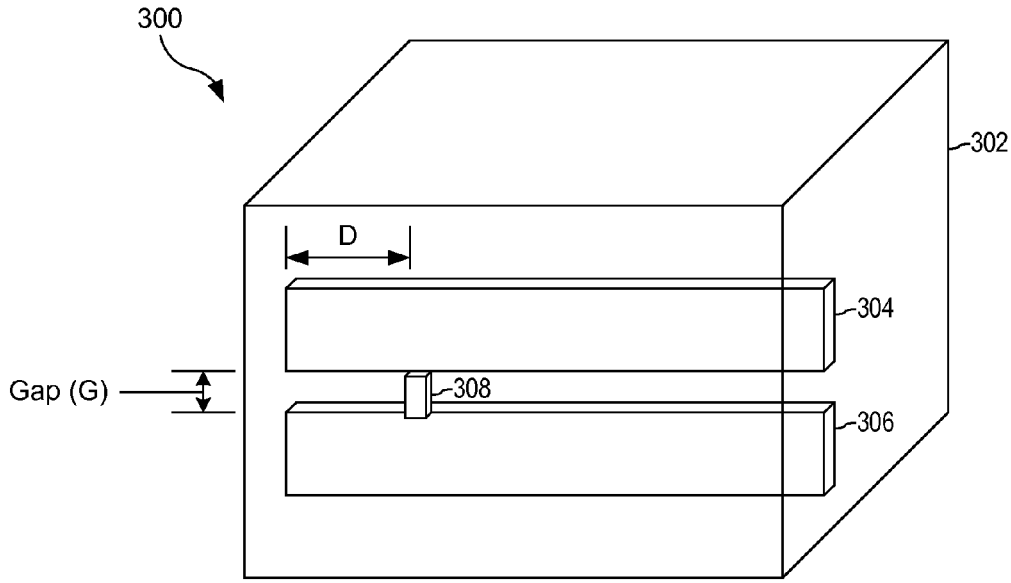
FIG. 3 is a resonant cavity with two metal plate insertions connected by a shorting bar.
Figure 4:
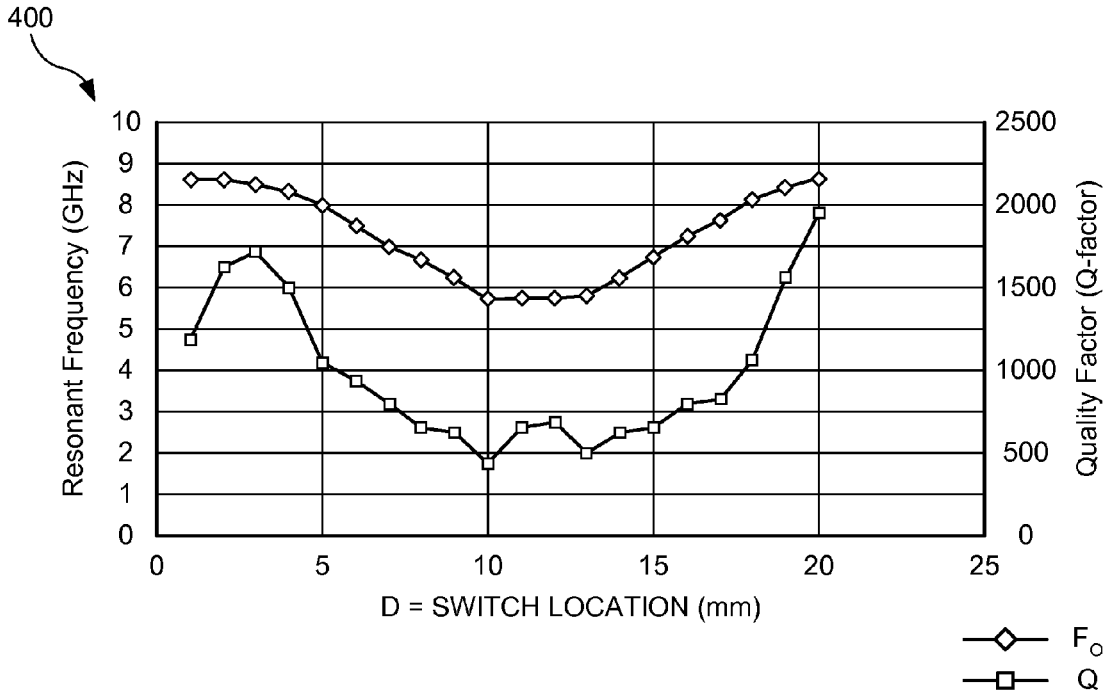
FIG. 4 is a graphical representation of the resonant frequency and the Q-factor of the resonant cavity with two metal plate insertions connected by a shorting bar with a varying position on the metal plate insertions.

FIG. 3 depicts a tunable resonant cavity 300 with two metal plate insertions connected by a shorting bar. The two metal plates 304 and 306 are inserted into a metallized box 302. There is a small gap G between the two metal plates 304 and 306. A shorting bar 308 is inserted within gap G to connect the two metal plates 304 and 306. The shorting bar 308 also modifies the resonant frequency of the cavity 300. Changing the position of the shorting bar 308 along the length of the two plates 304 and 306 varies the electric and magnetic fields within the cavity 300. FIG. 4 is a graphical representation 400 of the resonant frequency $F_0$ and the Q-factor of the resonant cavity 300 with two metal plate insertions connected by a shorting bar 308. The diamond plot points indicate the resonant frequency, which is shown on the left y-axis of the graph 400. The square plot points indicate the Q-factor, which is shown on the right y-axis of the graph 400. The x-axis represents the distance D (mm) of the shorting bar 308 from the left edge of the metal plates 304 and 306, as shown in FIG. 3. For this cavity 300, the resonant frequency $F_0$ is the highest when the shorting bar 308 is close to the edges (right or left) of the metal plates 304 and 306. As the shorting bar 308 moves into the middle of the metal plates 304 and 306 the resonant frequency $F_0$ decreases. In similar fashion, the Q-factor is the highest when the shorting bar 308 is close to the edges of the metal plates 304 and 306, and the Q-factor decreases as the shorting bar 308 moves into the middle of the metal plates 304 and 306. Accordingly, the movement of the shorting bar 308 tunes the cavity 300 frequency and maintains an effective Q-factor. In practice, a number of resonant cavities 300 can be combined to create a tunable cavity filter.

Figure 5:
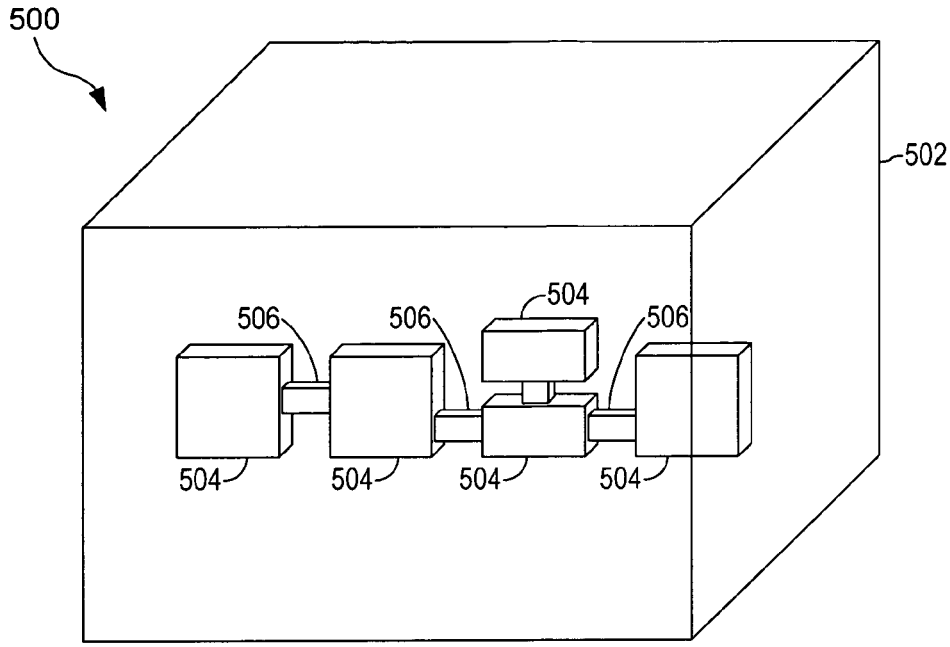
FIG. 5 is a tunable resonant cavity with multiple metal plate insertions connected by MEMS devices.

FIG. 5 depicts a tunable resonant cavity 500 with multiple metal plate insertions connected by MEMS devices. Multiple metal plates 504 are inserted inside a metallized box 502. The configuration of these metal plates 504 can be adjusted according to the tunability desired. The metal plates 504 can be connected by MEMS devices or circuitry 506. Rather than a single metal plate (FIG. 1) of varying height, a collection of metal plates 504 can be inserted within the cavity 500. The plates 504 can be dynamically interconnected using the MEMS devices 506. By electronically controlling the state of the MEMS devices 506, or reactively tuning MEMS varactors which interconnect the plates 504, the electric and magnetic fields can be effectively modified to alter the resonant frequency. Accordingly, the cavity 500 still retains a high Q-factor resonance. In this embodiment, the plates 504 can be close together with one or more MEMS devices 506 interconnecting the plates 504. In practice, a number of resonant cavities 500 can be combined to create a tunable cavity filter.

Figure 6:
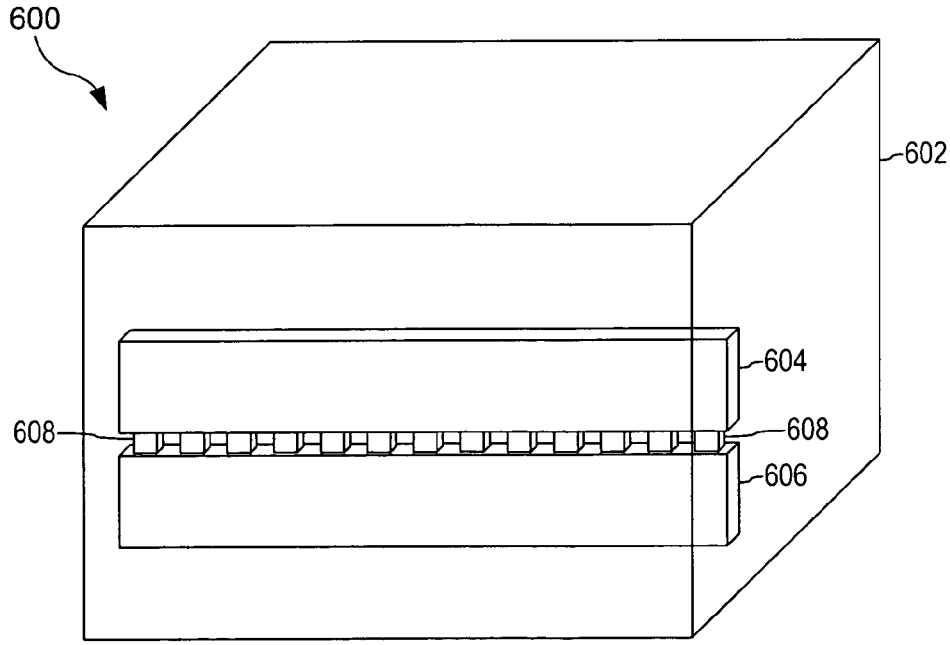
FIG. 6 is a tunable resonant cavity with two metal plate insertions connected by multiple shorting bars.

FIG. 6 depicts a tunable resonant cavity 600 with two metal plate insertions connected by multiple shorting bars. Two metal plates 604 and 606 are inserted inside a metallized box 602. In the gap between the two metal plates 604 and 606, multiple MEMS devices or circuitry 608 interconnect the plates. The MEMS devices 608 are electrical elements that connect or disconnect the metal plates 604 and 606. Instead of a single movable shorting bar (FIG. 3), the two plates 604 and 606 can be dynamically interconnected by the MEMS devices 608. Activation of the various MEMS devices 608 alter the electric and magnetic fields within the cavity 600. This embodiment can provide the same function as the movable shorting bar in FIG. 3, thereby creating a tunable filter with a high Q-factor. In practice, a number of resonant cavities 600 can be combined to create a tunable cavity filter.

Accordingly, actuation of MEMS devices (FIG. 5 and FIG. 6) or electronic devices (varactors, pin diodes, and FETs) can be used to modify the electric and magnetic fields of cavity resonators to effect changes in the resonant frequency. Embodiments, such as cavity 500 and cavity 600, can be used to construct high-performance tunable filters for a variety of communications, sensor, and electronic signal processing applications. In contrast, conventional filters use MEMS devices or electronic devices to modify the reactance (inductance or capacitance) of a lumped or distributed circuit.

Figure 7:
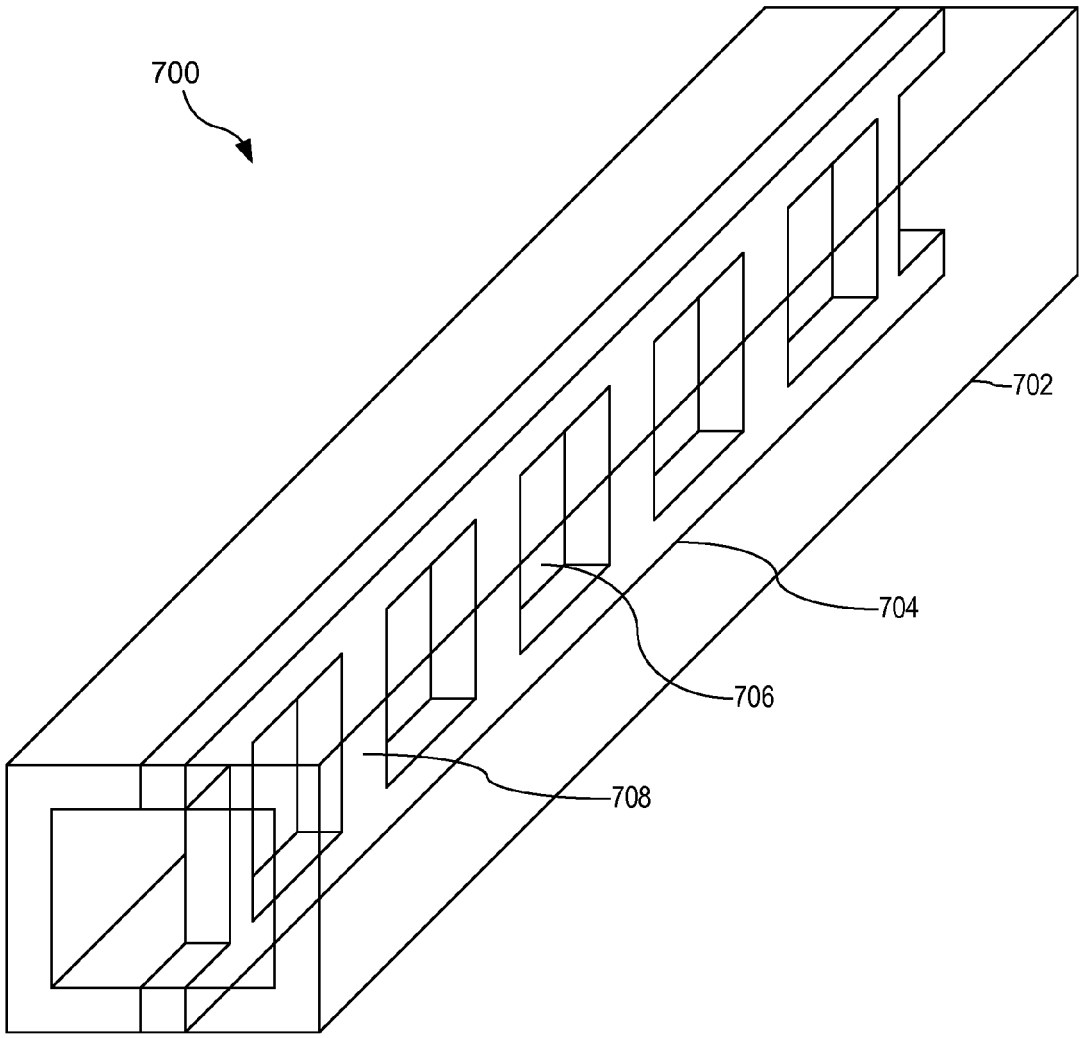
FIG. 7 PRIOR ART
FIG. 7 is a conventional waveguide filter.

An alternative embodiment involves incorporating MEMS tuned metal plates within the context of a fixed E-plane waveguide filter. FIG. 7 depicts a conventional waveguide filter 700. The waveguide 702 consists of two opposing, u-shaped metallic channels. A metal insert 704 is inserted in between the opposing channels. Accordingly, the waveguide 702 and the metal insert 704 provide a metal connection for the waveguide filter 700. Metal septums 708 on the metal insert 704 create multiple resonant waveguide cavities 706. These metal septums 708 constitute inductive coupling sections between the waveguide cavities 706. The metal septums 708 block most of the energy of a signal, but also allow some energy into the cavities 706. As previously described, the size of the cavities 706 determines their resonant frequency. Therefore, as energy from the signal is passed from one cavity 706 to another cavity 706, the waveguide filter 700 filters the signal corresponding to the resonant frequency of the cavities 706. A conventional waveguide filter 700 is not tunable because the cavities 706 within the metal insert 704 cannot be adjusted after manufacture.

Figure 8A:
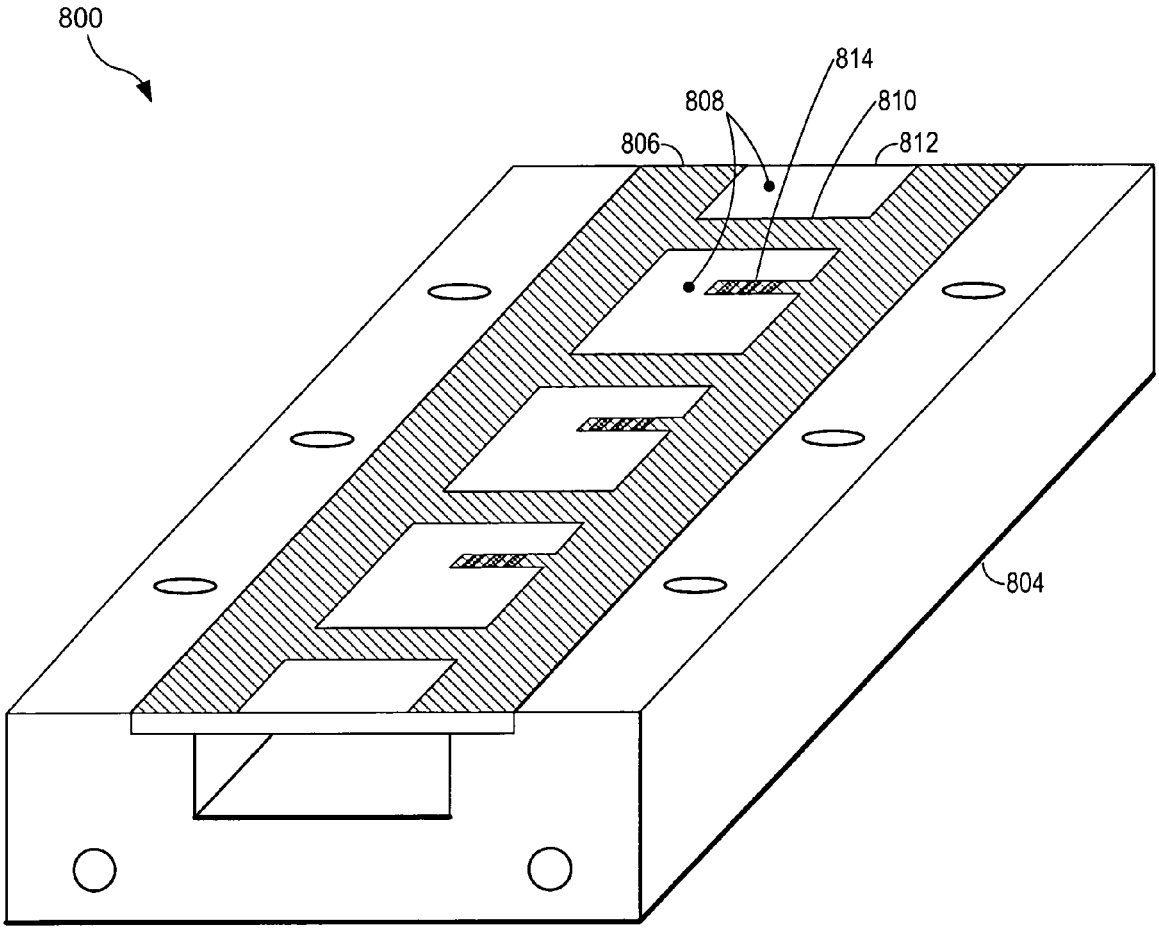
FIG. 8A is a bottom portion waveguide, a metal insert, and a substrate of a modified tunable waveguide filter.

FIG. 8A depicts a bottom portion waveguide 804, a metal insert 806, and a substrate 812 of a modified waveguide filter 800. The lower portion waveguide 804 is a u-shaped metallic channel. The metal insert 806 can be attached to the substrate 812. The substrate 812 can be a non-conductive dielectric material, such as a ceramic, glass, or quartz. The incorporation of a ceramic, glass, or quartz substrate 812 beneath the metal insert 806 can support metal traces. Metal septums 810 create multiple resonant waveguide cavities 808. MEMS devices and/or circuitry along with metal traces 814 reside on the substrate 812 within the cavities 808. By controlling the MEMS circuitry 814, the resonant frequencies of the cavities 808 are adjusted by connecting or disconnecting the metal traces. The metal insert 806 and substrate 812 is inserted into a ledge of the lower waveguide 804. This can allow the metal insert 806/substrate 812 to be flush with the top of the lower waveguide 804.

Figure 8B:
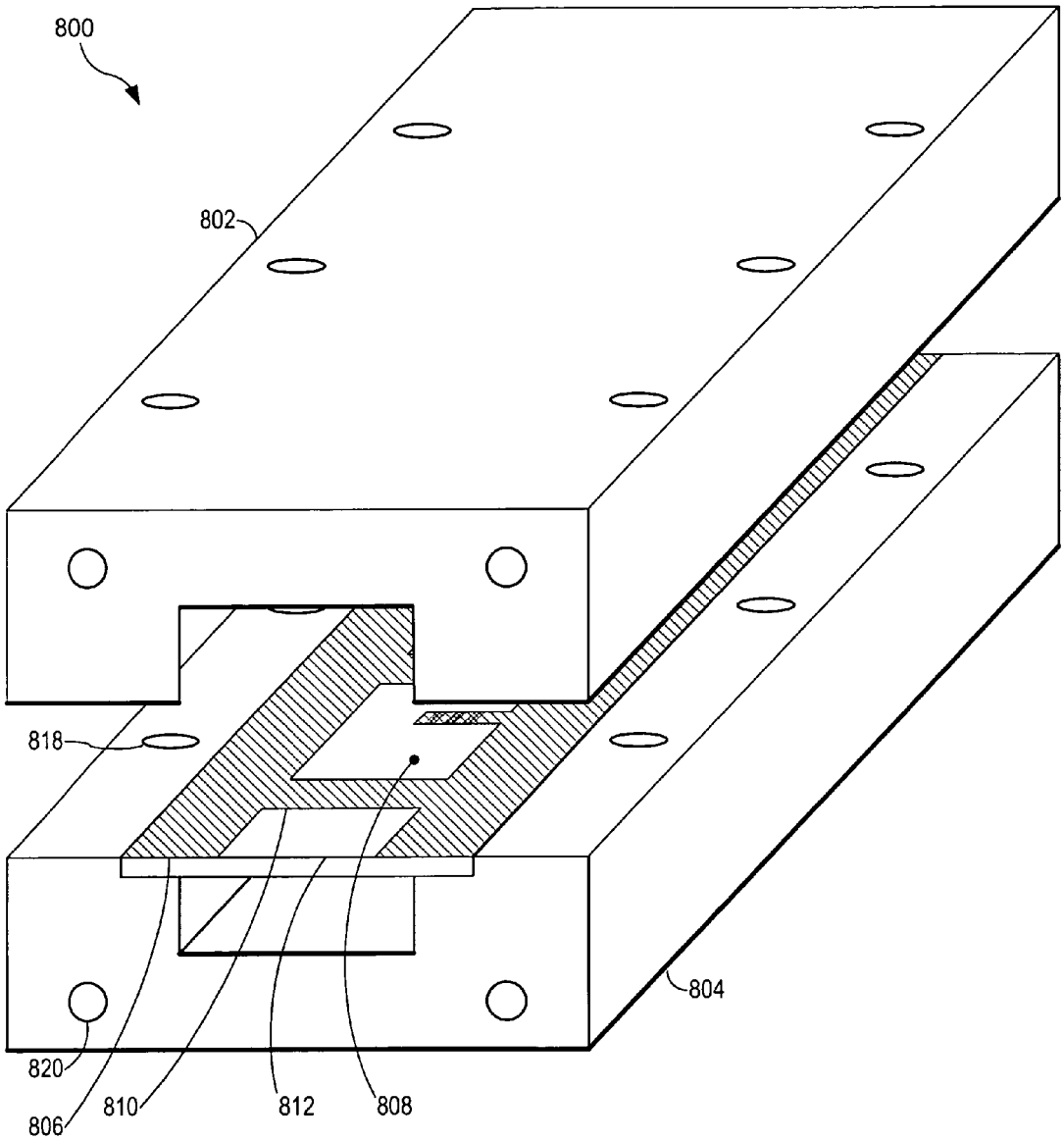
FIG. 8B is a top portion waveguide, the bottom portion waveguide, the metal insert, and the substrate of the tunable waveguide filter.
Figure 8C:
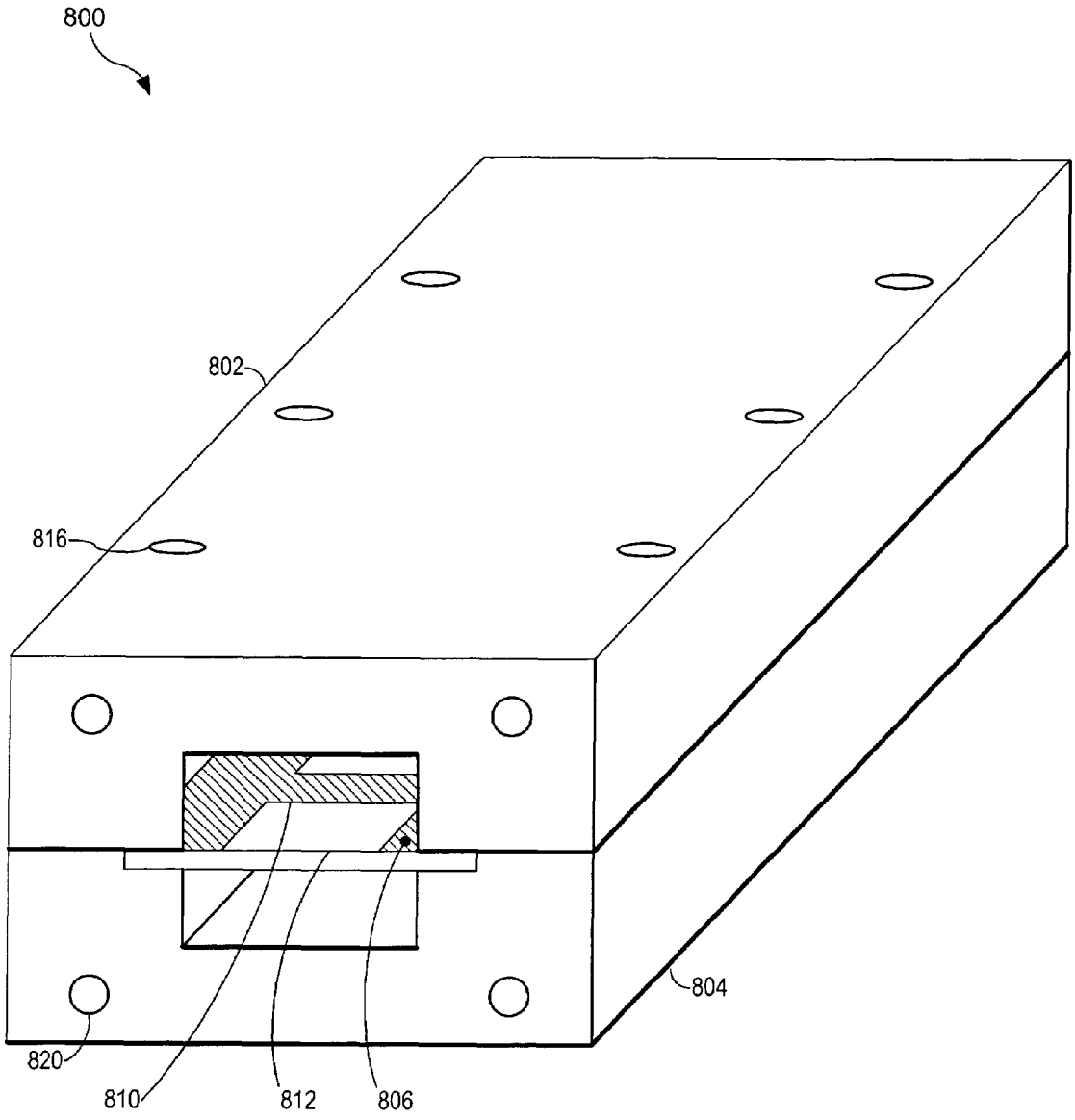
FIG. 8C is the assembled tunable waveguide filter.

FIG. 8B depicts a top portion (upper) waveguide 802, the bottom portion (lower) waveguide 804, the metal insert 806, and the substrate 812 of the modified waveguide filter 800. Accordingly, the upper waveguide 802 is placed on top of the lower waveguide 804. FIG. 8C depicts the assembled waveguide filter 800. FIG. 8C shows a rectangular waveguide, but other types of waveguides are within the scope of this disclosure. Square waveguides, circular waveguides, and the like can be used to create a waveguide filter. The upper waveguide 802, the metal insert 806 and the lower waveguide 804 are physically connected to each other. Screws inserted into the screw holes 816 (see FIG. 8C), 818 (see FIG. 8B) in the waveguide portions 802, 804 connect the waveguide filter 800. Screw holes 820 (see FIGS. 8B, 8C) enable one waveguide filter 800 to be attached to other pieces of waveguide. Other devices, such as bolts, nails and the like can replace the screws. The attachment of the upper waveguide 802 and the lower waveguide 804 comprise a metal connection between all of the components, including the metal insert 806.

The impact of the substrate 812 is to dielectrically load the cavities 808 (see FIG. 8B) and lower the resonant frequency of the cavities 808. The non-conductive substrate 812 does not adversely affect the inherent properties of the cavities 808. The substrate 812 may cause a slight additional dielectric loss in the cavities 808, but is a necessary mechanical support for the MEMS circuitry and metal traces used to tune the cavities 808. By placing additional metal traces and MEMS circuitry 814 (see FIG. 8A) on the substrate 812 in the area of the resonant cavities 808, the resonant frequency of the cavities 808 and the filter 800 can be tuned. In addition, by adding metal traces and MEMS circuitry 814 to the metal septums 810 (see FIGS. 8A, 8B, 8C), the inductive coupling between the cavities 808 can be modified also.

The MEMS devices and/or circuitry 814 on the substrate 812 can consist of printed lines and/or shapes. Accordingly, by connecting or disconnecting MEMS devices, the resonant frequencies of the cavities 808 and the filter 800 are altered. In other embodiments, the MEMS circuitry 814 can also comprise varactors, pin diodes, FET transistors, and the like.

Control circuitry can manage the MEMS devices 814 to enable the tuning of the filter 800. It is further noted that, some of the functions described within this disclosure, such as the functions of the control circuitry, may be performed in either hardware or software, or some combination thereof. Alternatively, these functions may be performed by a processor such as a computer or an electronic data processor in accordance with code such as computer program code, software, and/or integrated circuits that are coded to perform some functions.

Figure 9:
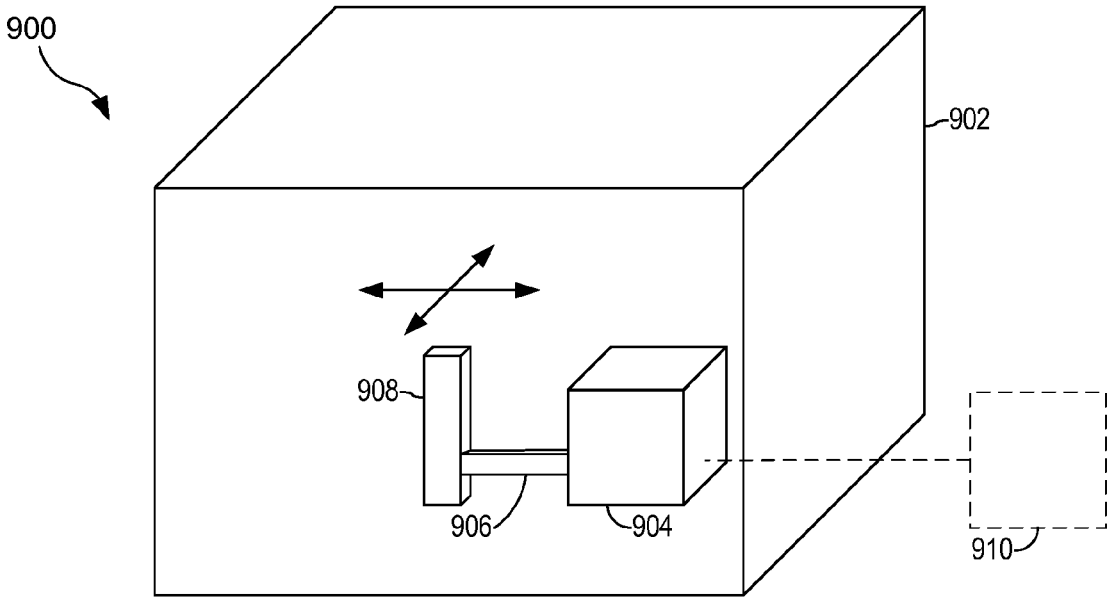
FIG. 9 is a tunable resonant cavity wherein a MEMS actuator and/or positioner is used to physically move material within the cavity.

In an alternative embodiment, changing the physical location of blocks of material with high permittivity or high permeability can also modify the electric and magnetic fields within a cavity. FIG. 9 depicts a tunable resonant cavity filter 900 wherein a MEMS actuator and/or positioner 904 is used to move material 908 within the cavity 900. The resonant cavity 900 is located within a metallized box 902. A connecting member (connection) 906 interconnects the MEMS actuator or positioner 904 and a block of material 908. MEMS circuitry 906 can provide the connection. In other embodiments, the connection 906 can comprise any physical connection between the MEMS positioner 904 and the block of material 908. The MEMS actuator or positioner 904 can move the physical location of the block of material 908. Control circuitry 910 controls the MEMS positioner 904 to enable tuning of the cavity filter. The positioner 904 can cause the block of material 908 to bend, curl, or crawl within the box 902. These types of movements alter the electric and magnetic fields within the cavity 900, and tune the resonant frequency of the cavity. The resonant cavity can also comprise latches, rails, and the like, to hold the material 908 in place within the cavity 900 after the material 908 has been physically moved or deformed. In practice, a number of resonant cavities 900 can be combined to create a tunable cavity filter.

Depending on the field distribution of the resonating mode and the size and material properties of the block 908, the resonant frequency of the cavity can be tuned. Accordingly, if the block 908 is moved to a part of the cavity with a weak electric or magnetic field, then the cavity 900 does not tune much. If the block 908 is moved to a part of the cavity with a strong electric or magnetic field, then the cavity 900 exhibits more tuning. During production of the cavity 900, the block of material 908 can be positioned accordingly. The block of material 908 can comprise a high permittivity material, such as ceramics, high resistivity silicon, and the like, or a high permeability material, such as nickel iron, ferrites, and the like. Accordingly, the MEMS positioner 904 can move conductive or non-conductive materials to alter the electric and magnetic fields of the cavity 900.

It is understood that the present invention can take many forms and embodiments. Accordingly, several variations of the present design may be made without departing from the scope of the invention. The capabilities outlined herein allow for the possibility of a variety of models. This disclosure should not be read as preferring any particular model, but is instead directed to the underlying concepts on which these models can be built.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A tunable cavity filter comprising at least one resonant cavity, wherein the at least one resonant cavity comprises:

at least two pieces of material within the at least one resonant cavity;

microelectromechanical ("MEMS") circuitry interconnecting the at least two pieces of material, wherein the MEMS circuitry can connect or disconnect the at least two pieces of material to alter the electric and magnetic fields inside the cavity.

2. The cavity filter of claim 1, wherein the at least two pieces of material are metal plates or metal traces.

3. The cavity filter of claim 1 further comprising control circuitry, wherein the control circuitry controls the MEMS circuitry to enable tuning of the cavity filter.

4. A tunable waveguide cavity filter, comprising:

a waveguide;

a metal insert attached to a substrate, wherein the metal insert provides at least one resonant waveguide cavity, wherein the at least one resonant waveguide cavity comprises:

at least two pieces of material; and circuitry selected from the group consisting of varactors, pin diodes, and field effect transistors (FETs), wherein the circuitry can connect or disconnect the at least two pieces of material to alter the electric and magnetic fields inside the cavity; and means for connecting the waveguide and the metal insert.

5. A tunable waveguide cavity filter, comprising:

a waveguide;

a metal insert attached to a substrate, wherein the metal insert provides at least one resonant waveguide cavity, wherein the at least one resonant waveguide cavity comprises:

at least two pieces of material; and

MEMS circuitry, wherein the MEMS circuitry can connect or disconnect the at least two pieces of material to alter the electric and magnetic fields inside the cavity; and means for connecting the waveguide and the metal insert.

6. The waveguide cavity filter of claim 5, wherein the waveguide further comprises an upper portion waveguide and a lower portion waveguide, which are opposing, unshaped metallic channels.

7. The waveguide cavity filter of claim 5, wherein the metal insert further comprises at least one metal septum.

8. The waveguide cavity filter of claim 5, wherein the at least two pieces of material and the MEMS circuitry are attached to the substrate.

9. The waveguide cavity filter of claim 8, wherein the at least two pieces of material are metal plates or metal traces.

10. The waveguide cavity filter of claim 5 further comprising control circuitry, wherein the control circuitry controls the MEMS circuitry to enable tuning of the waveguide cavity filter.

11. A tunable cavity filter comprising at least one resonant cavity, wherein the at least one resonant cavity comprises:

at least two pieces of material within the at least one resonant cavity;

circuitry interconnecting the at least two pieces of material, wherein the circuitry can connect or disconnect the at least two pieces of material to alter the electric and magnetic fields inside the cavity, and wherein the circuitry is selected from the group consisting of varactors, pin diodes, and field effect transistors (FETs).

12. A method of creating an electronically tunable cavity filter comprising at least one resonant cavity, wherein the method comprises:

inserting at least two pieces of material into the at least one resonant cavity;

interconnecting the at least two pieces of material with MEMS circuitry, wherein the MEMS circuitry can connect or disconnect the at least two pieces of material; and controlling the MEMS circuitry to enable tuning of the cavity filter.

13. The method of claim 12 wherein the at least two pieces of material are metal plates or metal traces.

14. The method of claim 13 wherein the tunable cavity filter comprises a waveguide cavity filter, wherein the waveguide cavity filter comprises:

a waveguide;

a metal insert attached to a substrate, wherein the metal insert provides the at least one resonant waveguide cavity; and means for connecting the waveguide and the metal insert.

15. The method of claim 14, wherein the metal insert further comprises at least one metal septum.

* * * * *